US007776183B2

(12) United States Patent
Wildfong et al.

(10) Patent No.: US 7,776,183 B2
(45) Date of Patent: Aug. 17, 2010

(54) TWIN WIRE GAP FORMER PAPER MAKING MACHINE WITH VARIABLE WRAP IMPINGEMENT SHOE

(75) Inventors: Vaughn Wildfong, East Longmeadow, MA (US); Thomas Helbig, Bernardston, MA (US)

(73) Assignee: AstenJohnson, Inc., Charleston, SC (US)

( * ) Notice: Subject to any disclaimer, the term of this patent is extended or adjusted under 35 U.S.C. 154(b) by 431 days.

(21) Appl. No.: 11/719,973

(22) PCT Filed: Nov. 16, 2005

(86) PCT No.: PCT/US2005/041455

§ 371 (c)(1),
(2), (4) Date: May 23, 2007

(87) PCT Pub. No.: WO2006/057871

PCT Pub. Date: Jun. 1, 2006

(65) Prior Publication Data

US 2007/0295468 A1 Dec. 27, 2007

Related U.S. Application Data

(60) Provisional application No. 60/630,393, filed on Nov. 23, 2004.

(51) Int. Cl.
*D21F 1/52* (2006.01)
*D21F 9/00* (2006.01)
*D21F 1/80* (2006.01)

(52) U.S. Cl. ..... 162/301; 162/212; 162/300; 162/351; 162/352

(58) Field of Classification Search ..... 162/203, 162/271, 300, 301, 303, 351, 352, 365, 366
See application file for complete search history.

(56) References Cited

U.S. PATENT DOCUMENTS

| | | | | |
|---|---|---|---|---|
| 3,997,390 | A | 12/1976 | Kankaanpaa | |
| 4,523,978 | A * | 6/1985 | Pullinen | 162/300 |
| 4,648,943 | A | 3/1987 | Malashenko et al. | |
| 4,684,441 | A * | 8/1987 | Ibrahim | 162/198 |
| 5,635,032 | A | 6/1997 | Bubik et al. | |
| 6,117,271 | A * | 9/2000 | Page | 162/203 |
| 6,361,657 | B2 | 3/2002 | McPherson | |
| 6,372,091 | B2 | 4/2002 | Wildfong et al. | |
| 6,712,941 | B2 * | 3/2004 | Sherril | 162/352 |
| 7,364,643 | B2 * | 4/2008 | Poikolainen et al. | 162/203 |
| 2003/0173048 | A1 | 9/2003 | Buchanan et al. | |

* cited by examiner

*Primary Examiner*—Eric Hug
(74) *Attorney, Agent, or Firm*—Volpe and Koenig, P.C.

(57) ABSTRACT

A forming section for a gap blade former type papermaking machine having a headbox which delivers a jet of papermaking stock between a conveying forming fabric and a backing forming fabric is provided. The conveying fabric moves in sliding contact over an impingement shoe on which the jet of papermaking stock is delivered at a point of impingement. A forming shoe located immediately downstream of the impingement shoe over which the backing forming fabric slides. The impingement shoe is mounted for at least one of pivoting and transverse movement so that a position of the point of impingement of the jet of papermaking stock can be adjusted by at least one of rotating the impingement shoe about a first pivot point and transversely shifting the impingement shoe. The forming shoe can also be mounted for movement.

19 Claims, 6 Drawing Sheets

TWIN WIRE GAP FORMER PAPER MAKING MACHINE WITH VARIABLE WRAP IMPINGEMENT SHOE

CROSS-REFERENCE TO RELATED APPLICATIONS

This application is a 371 National Phase of PCT/US2005/041455, filed on Nov. 16, 2005, which claims the benefit of U.S. Provisional Application 60/630,393, filed Nov. 23, 2004.

BACKGROUND

The present invention concerns a twin fabric gap blade type forming section of a papermaking machine and an apparatus for improving sheet formation therein.

The modern two fabric (or twin wire) papermaking machines in which the papermaking stock or furnish is delivered from the headbox slice lip into the gap between two converging forming fabrics is often referred to as a gap former. In a gap former, one of the two forming fabrics is supported either by wrapping it around a rotating roll surface, or by wrapping it over the fabric support surfaces comprised of a series of blades mounted on a supporting stationary shoe. There are two types of gap formers.

In the first type of gap former, referred to as a gap roll former, initial impingement of the stock jet is onto a fabric supported on a roll surface; this arrangement provides for constant pressure drainage, with excellent fiber retention, excellent tolerance to impingement angle variations, but poor sheet formation due to the absence of the beneficial pressure pulses provided by blade edges.

In the second type of gap former, known as a gap blade former, the initial impingement of the stock jet is onto a fabric which is supported by a series of blade surfaces. The strong pressure pulses generated by fabric deflection at the edges of each blade surface results in excellent sheet formation, but poor fiber retention and an almost zero tolerance for variations in the angle of impingement of the stock jet from the headbox slice.

Recent advances in two fabric forming technology have included the introduction of stationary curved impingement shoe technology, for example, as shown in US 2003/0173048 to Buchanan et al. The stationary curved impingement shoe, which is partially wrapped by both fabrics, replaces the roll or blade impingement zones described above. The curved impingement shoe provides an impingement zone that dewaters the sheet in a manner similar to that obtained with a curved roll surface as in the gap roll former, but combined with a series of much gentler pressure pulses than are possible with the traditional bladed stationary shoe as in the gap blade former. In gap formers equipped with the stationary curved impingement shoe such as those described in the present invention, a fabric lead-in roll is present immediately upstream to the impingement shoe.

Following the initial impingement zone in any of these aforementioned roll, blade or impingement type gap former arrangements, the two forming fabrics together with the papermaking furnish sandwiched between them pass over a stationary bladed forming shoe for further dewatering and formation enhancing pressure pulses provided by the blade edges. This formation shoe is most often placed on the inside run of the opposite fabric to that on which the impingement occurs to provide for a balancing of the drainage. It is also known to use adjustable pressurized blades that can be loaded by means of hydraulic or air pressure so as to push them into the fabrics, such as are described by U.S. Pat. No. 6,361,657, that are mounted opposite the stationary bladed forming shoe so that the individual pressurized blades can press into the two fabrics (with the stock sandwiched between them) in the gaps between the stationary blades on the forming shoe.

The adjustable pressurized blades provide a further degree of adjustment and control over the magnitude of the pressure pulses occurring at each stationary blade edge. These adjustable blades are capable of providing dramatic improvements in sheet quality, but only if the sheet consistency entering this portion of the forming section is within a very narrow range that permits beneficial fiber realignment. If the consistency is too high or too low, then the use of these blades can be detrimental to sheet quality, rather than providing an improvement.

The consistency of the embryonic sheet entering the opposed blade section is determined by many factors, including: basis weight of the product being manufactured, consistency of the stock exiting the headbox slice, composition of the stock and, most importantly, the amount of drainage occurring in the initial impingement zone. The drainage occurring in the initial impingement zone, whether it be in a gap roll, gap blade or curved impingement shoe forming arrangement, is also dependant on the above mentioned factors as well as the fabric tension and the angle of wrap (i.e. the amount of the curved surface over which the two fabrics wrap in the impingement zone). It is well known that the angle of wrap in the impingement zone is fixed by machine geometry and therefore the consistency entering the opposed blade section will change if any of the operational variables fluctuate, and consequently paper quality will suffer.

The headbox is a massive object and, although so-called slice lips are provided which may be used to direct the stream of stock being ejected from the headbox onto a desired location on the impingement shoe, fine control of these lips is imprecise and cumbersome. It is very difficult in practice to precisely direct the stock jet onto the impingement shoe so that it impacts at a specific location with precision.

U.S. Pat. No. 4,523,978 discloses the use of a forming shoe in a twin wire former. The forming shoe is located downstream of the initial single wire portion of the forming section so that it only acts after some degree of felting of the embryonic paper web has taken place and the fibers are no longer able to move relative to each other. The position or attitude of the forming shoe is adjustable in order to adjust the dewatering capability of the forming section as well as web formation. This arrangement is not indicated as effecting fiber distribution in the embryonic paper web.

SUMMARY

Briefly stated, the present invention is directed to an improved forming section of the type in which the stock jet is delivered from a headbox slice onto a first of a pair of moving forming fabrics at a location where the first fabric (known as the conveying fabric) passes in sliding contact over an impingement shoe. The impingement shoe is followed by a forming shoe upon which are mounted a plurality of fixed formation blades. Preferably, an opposing blade unit is provided with a plurality of resiliently mounted formation blades located opposite the forming shoe so that the blades are positioned in between the blades of the forming shoe and press into the fabrics to provide a series of pressure pulses which provide energy to randomize fiber distribution and improve sheet formation. Opposing blade units are preferable for most, but not all, paper grades. At least one of the impingement shoe and the forming shoe, and more preferably both the impingement shoe and forming shoe, are mounted in an adjustable manner. This allows the effective drainage length of the stock sandwiched between the forming fabrics at the impingement shoe, and thus a consistency of the stock, to be adjusted prior to the formation shoe based on the effective wrap angle, and also allows the fabric deflection angle of the forming fabrics between the impingement shoe and the formation shoe to be adjusted to prevent overstressing and damage to the embryonic web being formed as it is carried to the formation shoe.

Through the ability to adjust a position of the impingement shoe and/or formation shoe in a quick and efficient manner, stock consistency can be optimized so as to maximize the benefit obtained from the pressure pulses provided by the impingement and formation shoes. This allows the papermaking machine to efficiently produce a wider variety of paper products with a shorter turnaround time than has hitherto been possible.

The invention is based, in part, on the determination that the consistency of the stock entering the forming section can be controlled by altering the location of the point of impingement of the stock jet onto the forming fabric which wraps the curved impingement shoe. This changes the effective drainage length without having to move the headbox structure. Unlike the roll former with its fixed structure, the impingement point of the stock jet on the impingement shoe in a gap former can be moved according to the invention by combining a very small but controlled amount of rotation and/or linear movement of the impingement shoe while leaving the trajectory of the headbox jet unchanged. In one preferred embodiment, a pivot point is provided for the impingement shoe and is located such that the fabric path between the trailing edge of the impingement shoe and the leading edge of the formation shoe remains in approximately the same position, while the lower (upstream) portion of the curved impingement shoe is caused to rotate so that the jet impinges further downstream onto the impingement shoe, thus reducing the effective drainage length.

The lead-in roll is preferably also moved in a linked manner with the impingement shoe as an assembly to ensure that the position of the front edge of the shoe remains constant relative to the lead-in roll.

Additionally, an effective wrap angle of the sandwiched forming fabrics with the stock located therebetween about the impingement shoe can be increased, maintained or diminished in a precisely controlled fashion during normal operation of the papermaking machine so as to provide more or less dewatering for adjustment to various sheet properties.

These features of the invention allow the consistency of the stock entering the opposing blade portion of the forming section to be more precisely controlled than has previously been possible by altering the location of the point of impingement of the stock jet, thereby changing the effective drainage length of the stock and forming fabrics over the impingement and forming shoes, without having to move the huge headbox structure. By using the features of the present invention, it is now possible to quickly and efficiently alter the position of the impingement point of the stock jet on the impingement shoe. This is accomplished by imparting a very small, but precisely controlled amount of movement, such as by rotation and/or linear movement to either the impingement shoe, the forming shoe, or both the impingement and forming shoe, while leaving the trajectory of the headbox jet unchanged.

In a second aspect of the present invention, the downstream forming shoe assembly is also moveable, preferably by incorporating another pivot point and/or transverse adjustment, which would allow for movement by rotation or transverse adjustment at a position immediately downstream of the impingement shoe. This assists in controlling a fabric deflection angle of the forming fabrics as they pass from the impingement shoe to the forming shoe in instances where the position of the fabrics at the trailing edge of the impingement shoe require adjustment to optimize paper formation properties.

In one embodiment, both the impingement shoe and the forming shoe are moved cooperatively so as to provide the necessary adjustments to formation properties, if necessary. Alternatively, the impingement shoe and the forming shoe are moved independently using separate controls or adjustments.

In another aspect of the invention, the forming shoe is linked to the impingement shoe by a linkage arrangement or via logic programmed into one or more controllers so that movements of the impingement shoe provide cooperative movements of the forming shoe.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

Figure 1:
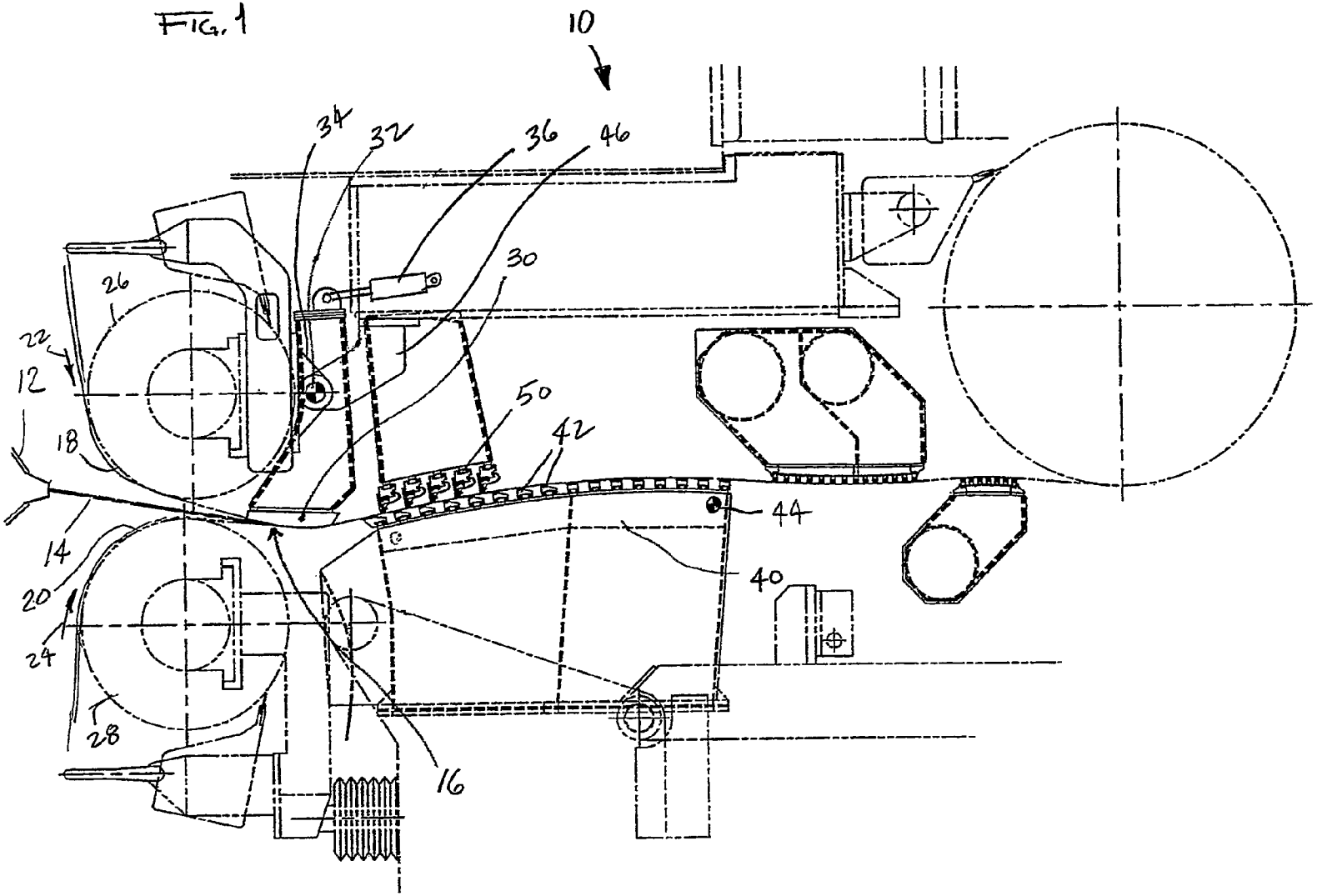
FIG. 1 is a side elevation view of a forming section for a gap blade former type papermaking machine in accordance with a first preferred embodiment of the invention.

Certain terminology is used in the following description for convenience only and is not considered limiting. The words "lower", "upper", "left" and "right" designate directions in the drawings to which reference is made. The terms "a" and "one" are defined as including one or more of the referenced item unless specifically noted. The term "effective wrap angle" refers to the wrap angle from the jet impingement point to the trailing edge of the impingement shoe. The term "fabric deflection angle" refers to the angle formed by the fabric at the trailing edge of the impingement shoe and/or the leading edge of the forming shoe.

Referring now to FIG. 1, a forming section 10 for a gap blade former type papermaking machine is shown. The forming section 10 includes a head box 12 which delivers a jet of papermaking stock 14 toward a point of impingement 16 on a conveying forming fabric 18. A backing forming fabric 20 is also provided and converges with the conveying forming fabric 18 at or very near to the point of impingement. The fabrics 18, 20 are each mounted for advancing movement in the direction of arrows 22, 24 and have facing advancing sides between which the embryonic paper web is formed from the papermaking stock. Both fabrics 18, 20 are wrapped around lead-in rolls 26, 28 located immediately downstream of the head box 12. The conveying fabric 18 is carried over an impingement shoe 30 over which it moves in sliding contact. The jet 14 of papermaking stock is delivered at the point of impingement 16 at a position over the impingement shoe 30, between the forming fabrics 18, 20.

A forming shoe 40 is located immediately downstream of the impingement shoe 30. The backing forming fabric 20 slides over the forming shoe 40 to further distribute fibers in the papermaking stock and dewater the web. The two forming fabrics 18, 20 with the embryonic paper web sandwiched therebetween preferably encounter a series of blade edges 42 on the forming shoe which create pressure pulses to enhance dewatering. An oppositely mounted series of adjustable pressurized blades 50 are preferably also provided and can be loaded by means of hydraulic or air pressure so as to push them into the fabrics 18, 20, as described in U.S. Pat. No. 6,361,657, which is incorporated herein by reference as if fully set forth.

According to the invention, the impingement shoe 30 is mounted for at least one of pivoting and transverse (left-right) movement so that a position of the point of impingement 16 of the jet of papermaking stock 14 on the conveying fabric 18 in an area of sliding contact over the impingement shoe 30 is adjustable by at least one of rotating the impingement shoe 30 about a first pivot point 32 and transversely shifting the impingement shoe 30. In the embodiment shown in FIG. 1, the impingement shoe 30 is pivotally mounted about the pivot point 32 and supported by a mounting arrangement 34. An actuator 36 is provided which can be used to pivot the impingement shoe 30 about the pivot point 32. The actuator 36 may be mechanical, hydraulic, pneumatic, or electrically driven, and may be manually adjusted or more preferably controlled via a controller (not shown) to allow for pivoting adjustment of a position of the impingement shoe 30 in order to adjust the point of impingement 16 and maintain it in a desired position, depending upon the particular requirements of the papermaking stock being utilized.

The lead-in roll 18 is preferably linked to the impingement shoe 30 so that adjustments in the position of the impingement shoe 30 provide corresponding adjustments to a position of the lead-in roll in order to maintain a desired lead-in angle for the conveying fabric 18 to the leading edge of the impingement shoe 30.

Still with reference to FIG. 1, the forming shoe 40 is preferably mounted for at least one of pivoting and transverse movement. This allows a position of at least a leading edge of the forming shoe 40 to be adjustable by at least one of rotating of the forming shoe 40 about a second pivot point 44 and transversely shifting the forming shoe, as explained in further detail below, in order to adjust a wrap angle of the conveying fabric 18 and the backing fabric 20. The second pivot point 44 is preferably located at or near a downstream side of the forming shoe 40 so that pivoting movement has little effect on a trailing edge position of the fabrics 18, 20 as they exit the forming shoe 40. However, the leading edge of the forming shoe 40 can be adjusted as required in order to maintain a low fabric deflection angle of the fabrics 18, 20 as they transition from the impingement shoe 30 to the forming shoe 40, in order to prevent a high shear from being transmitted to the fibers of the papermaking stock, which can cause formation defects.

In a preferred embodiment, the forming shoe 40 is linked to the impingement shoe 30 such that movement of the impingement shoe 30 provides a corresponding movement of the forming shoe 40. This is preferably accomplished via a linkage 46 which is connected to the impingement shoe 30 and causes movement of the forming shoe 40 as well as the structure for supporting the oppositely mounted series of adjustable pressurized blades 50. This can be in the form of a simple linkage 46 or, if necessary, a more complex linkage may be provided to provide a desired movement characteristic between the trailing edge of the impingement shoe 30 and the leading edge of the forming shoe 40.

Figure 2:
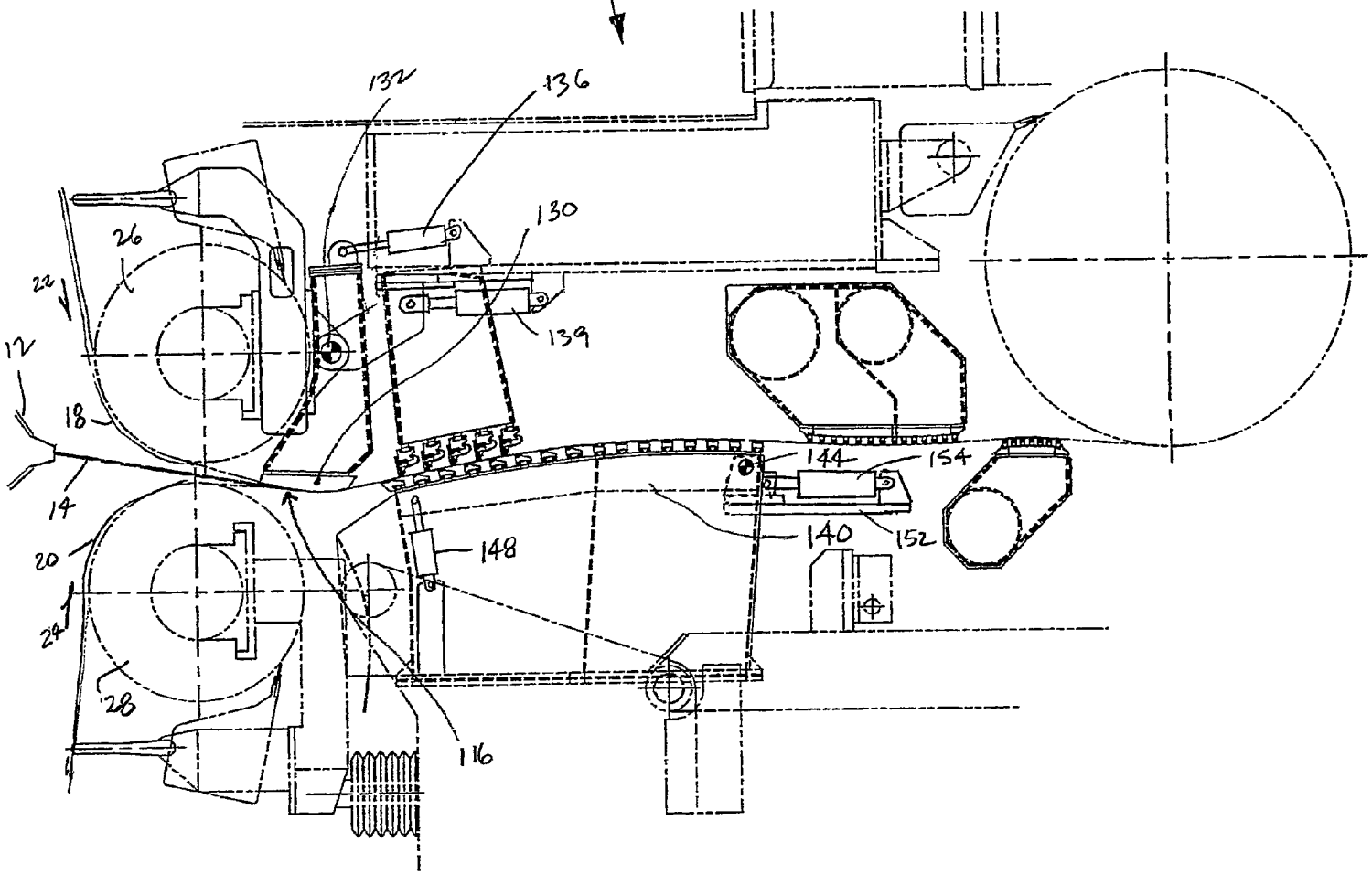
FIG. 2 is a side elevation view of a forming section for a gap blade former type papermaking machine in accordance with a second preferred embodiment of the present invention.

Referring now to FIG. 2, a second embodiment of a forming section 110 in accordance with the present invention is shown. The forming section 110 is similar to the forming section 10 and includes the conveying fabric 18 and backing fabric 20 which travel in the advancing direction 22, 24 on lead-in rollers 26, 28. The jet of stock 14 from the head box 12 contacts the impingement shoe on 130 at an impingement point 116. The forming shoe 140 is mounted for at least one of pivoting and transverse movement so that a fabric deflection angle of the fabrics 18, 20 in an area between a trailing edge of the impingement shoe 130 and a leading edge of the forming shoe 140 is adjusted by at least one of rotating the forming shoe 140 about a first pivot point 144 and transversely shifting the forming shoe 140. Pivoting movement is preferably accomplished via an actuator 148 which may be a hydraulic, mechanical, pneumatic or electrically driven actuator which is utilized to adjust a leading edge position of the forming shoe on 140 by tilting up or down. The forming shoe 140 may also be mounted for transverse (left-right) movement on a support structure 152 which includes an actuator 154 that can be used to transversely shift a position of the pivot point 144. This can be utilized to adjust a gap between the trailing edge of the impingement shoe 130 and the leading edge of the forming shoe 140. Preferably, the actuators 148 and 154 are controlled via a controller in order to allow precise movement of the forming shoe 140 to a desired position depending upon the type and consistency of the papermaking stock and the type of paper being made.

The impingement shoe 130 is preferably also mounted for a pivoting movement about the first pivot point 132 which is controlled via actuator 136. The first pivot point 132 can also be transversely shifted via actuator 139. The actuators 136 and 139 are preferably also controlled via the controller to allow a desired position and holding of the impingement shoe 130 at a desired angle so that a desired impingement point 116 and effective wrap angle can be achieved. The controller may provide a logical linkage between movement of the impingement shoe 130 and the forming shoe 140 based upon control signals to one or more of the actuators 136, 139, 148 and 154 to provide a linked movement between the impingement shoe 130 and the forming shoe 140.

Figure 4:
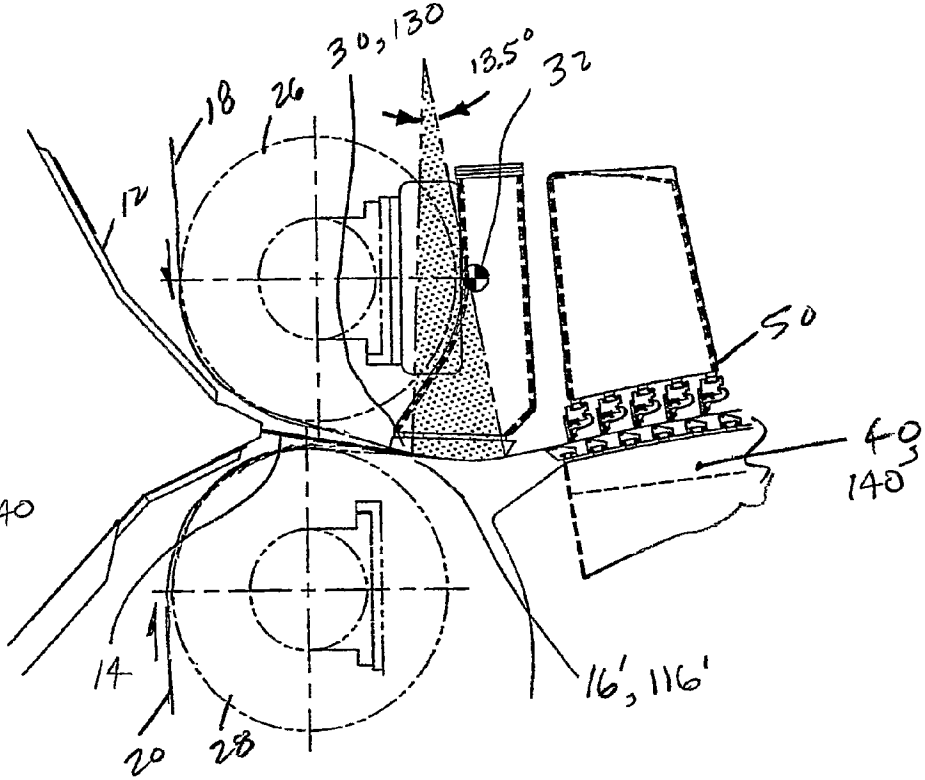
FIG. 4 is a view similar to FIG. 3 showing the point of impingement located near a leading edge of the impingement shoe after an adjustment in the position of the impingement shoe according to the present invention.
Figure 3:
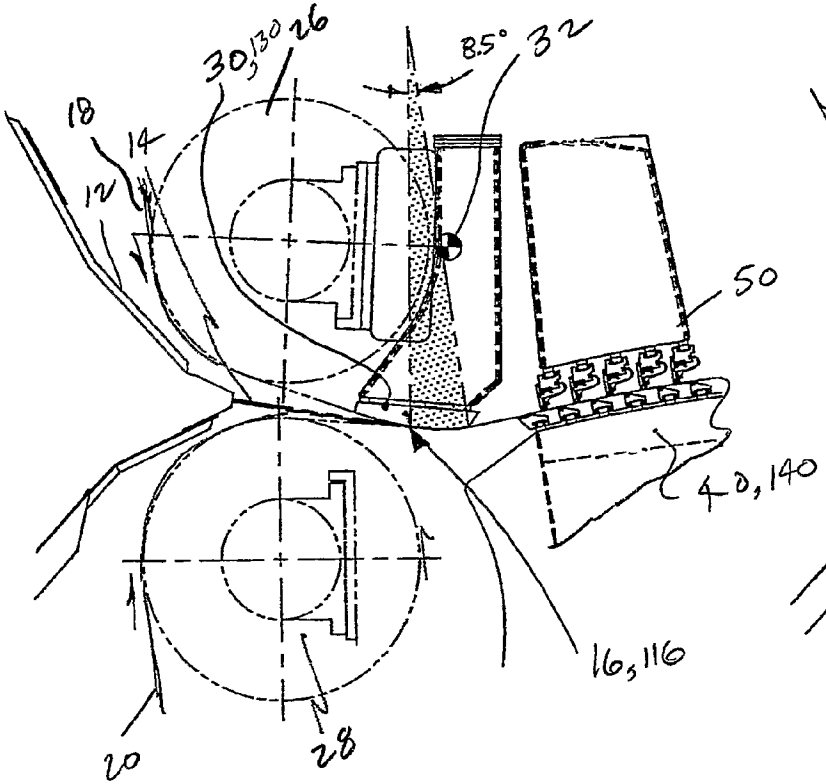
FIG. 3 is an enlarged view of the lead-in rolls for the forming and backing fabrics with the impingement shoe in a first location in which the point of impingement is located downstream from a leading edge of the impingement shoe.

Referring now to FIGS. 3 and 4, the adjustment of the impingement shoe 30, 130 will be explained in detail. In FIG. 3, the impingement shoe 30 is shown with an effective wrap angle between the sandwiched fabrics 18, 20 and the impingement shoe 30, 130 of about 8.5°, with the point of impingement 16 being located at about a medial position on the impingement shoe 30, 130. This results in a shorter effective drainage length on the surface of the impingement shoe 30, 130 starting from the impingement point 16, 116 and ending at the trailing edge of the impingement shoe 30, 130. Depending upon a consistency of the stock and the type of paper being manufactured, it may be desirable to remove additional water from the stock provided by the jet 14 prior to the fabrics 18, 20 leaving the trailing edge of the impingement shoe 30, 130 and contacting the leading blade 42 of the forming shoe 40, 140. In order to increase the dewatering effect of the impingement shoe 30, 130, it is preferably rotated about the first pivot point 32, as shown in FIG. 4. This adjustment of the impingement shoe 30, 130 by rotation about the pivot point 32 changes the impingement point to a point 16', 116' closer to a leading edge of the impingement shoe 30, 130. In the example shown, the effective wrap angle of the fabrics 18, 20 along the impingement shoe is changed to 13.5° by rotation of the impingement shoe 30, 130 in a counter clockwise manner which also results in the impingement point 16', 116' of the jet on the impingement shoe 30, 130 to be closer to a leading edge of the impingement shoe 30, 130. Preferably, the lead-in roll 26 is rotated with the impingement shoe so that an angle of the conveying fabric 18 at the leading edge of the impingement shoe 30, 130 does not change.

In order to ensure that the embryonic paper web formed between the backing and conveying fabrics 18, 20 is not damaged due to too high or too low of a wrap angle between the trailing edge of the impingement shoe 30, 130 and the leading edge of the forming shoe 40, 140, the forming shoe 40, 140 can be moved in connection with an adjustment of the position of the impingement shoe 30, 130. This can be done separately, or through a linked or controlled movement of both the forming shoe 30, 130 and impingement shoe 40, 140 which can be accomplished via a mechanical linkage, such as the mechanical link 46 shown in FIG. 1, or via a control logic linkage through the use of separate actuators controlling at least one of a rotation angle position of the forming shoe 40, 140, such as via the actuator 148 shown in FIG. 2. Additionally, a distance between the trailing edge of the impingement shoe 130 and a leading edge of the forming shoe 140 can be adjusted, for example via a transverse motion controlled by an actuator, such as actuator 139 or 154. This allows precise positioning of the impingement point of the jet 14 of papermaking stock on the impingement shoe 30, 130 to provide for the desired drainage by the impingement shoe, as well as allowing for adjustment of the gap and fabric deflection angle between a trailing edge of the impingement shoe 30, 130 and a leading edge of the forming shoe 40, 140, described in further detail below.

Preferably, the range of motion of the leading edge of the impingement shoe to obtain beneficial effects on the stock is in the range of from about 0.5 mm to about 5 mm in normal operation, depending on grade of product being made by the paper machine. Heavier basis weights will have a thicker fabric-slurry-fabric sandwich. In extreme cases of basis weight changes, it may necessary to move the leading edge of the impingement shoe up to about 10 mm or more although movement in the range of up to 15 mm may be necessary depending on the papermaking variables.

Similarly, movement of the leading edge of the forming shoe should normally be in the range of from about 0.5 mm to about 5 mm, but may include movement of the leading edge by as much as 20 mm.

Figure 5A:
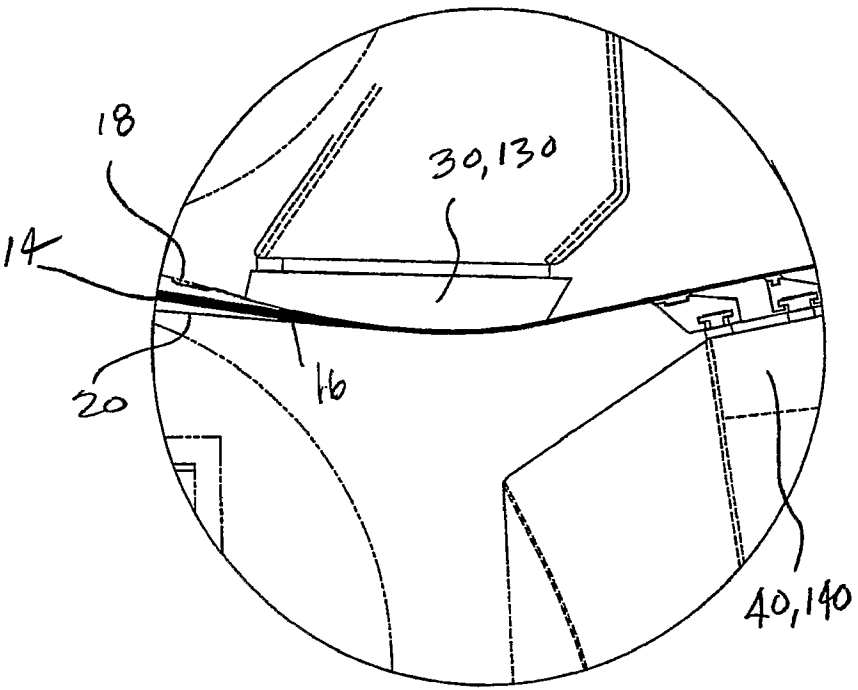
FIGS. 5 and 5*a* show the trailing edge of the impingement shoe and leading edge of the forming shoe in a first position for use in connection with a thin papermaking stock.
Figure 5:
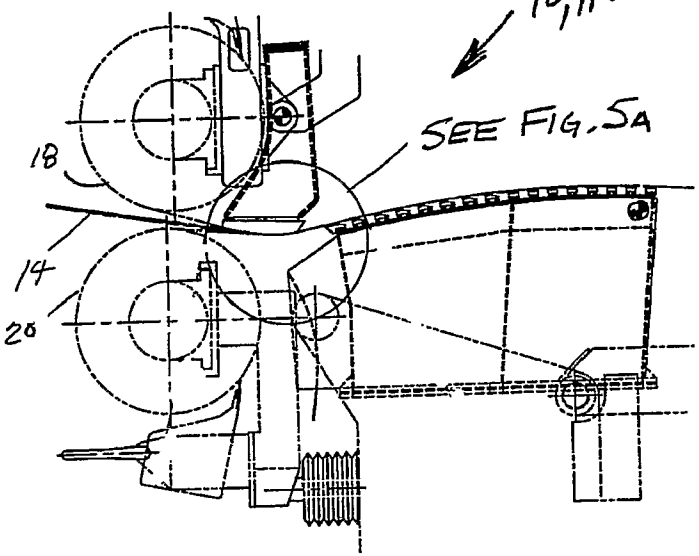

Referring now to FIGS. 5 and 5*a*, a view of the jet 14 of papermaking stock at the impingement point 16 on the impingement shoe 30 is shown. Based on the consistency of the stock and the amount of dewatering to be carried out by the impingement shoe 30, the thickness of the sandwich created by the backing fabric 20, the conveying fabric 18 and the papermaking stock trapped between the fabrics, the fabric deflection angle between a trailing edge of the impingement shoe 30, 130 and a leading edge of the forming shoe 40, 140 is set so that there is a low deflection angle (of about 0.5°) which prevents high shear which can result in crushing of the fibers and potential damage to the embryonic web being formed from the papermaking stock. Additionally, if a deflection angle is too low, this would result in the sandwich not being pressed firmly together, also potentially resulting in damage to the embryonic paper web.

Figure 6A:
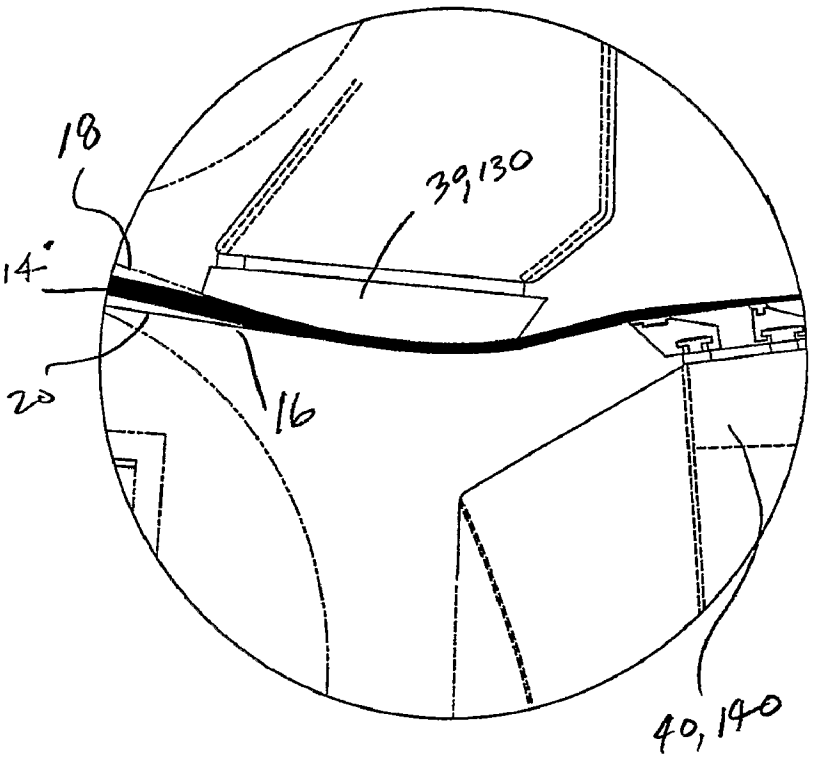
FIGS. 6 and 6*a* show a thick papermaking stock being delivered from the head box with the impingement shoe and forming shoe being in the same location as in FIGS. 5 and 5*a*, resulting in a high wrap angle between the trailing edge of the impingement shoe and the leading edge of the forming shoe.
Figure 6:
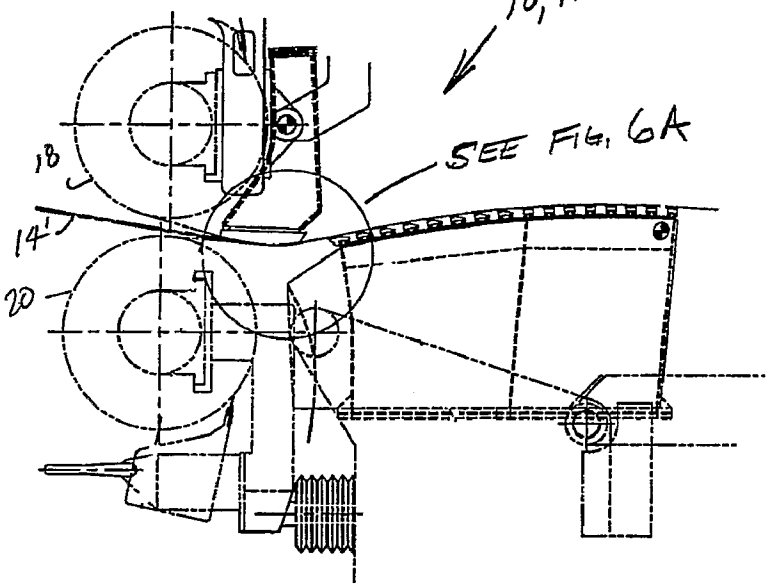

FIGS. 6 and 6*a* show the impingement shoe 30, 130 and the forming shoe 40, 140 in the same locations as in FIGS. 5 and 5*a* after a change to a different grade of paper. A thicker paper making stock is provided by the jet 14'. Due to the increased thickness of the stock, the overall thickness of the sandwich formed by the conveying fabric 18, backing fabric 20 and the furnish trapped between the fabrics 18, 20 at a point between the trailing edge of the impingement shoe 30, 130 and a leading edge of the forming shoe 40, 140 creates a greater deflection angle than is desirable. This can result in damage to the embryonic web of paper being formed.

Figure 7A:
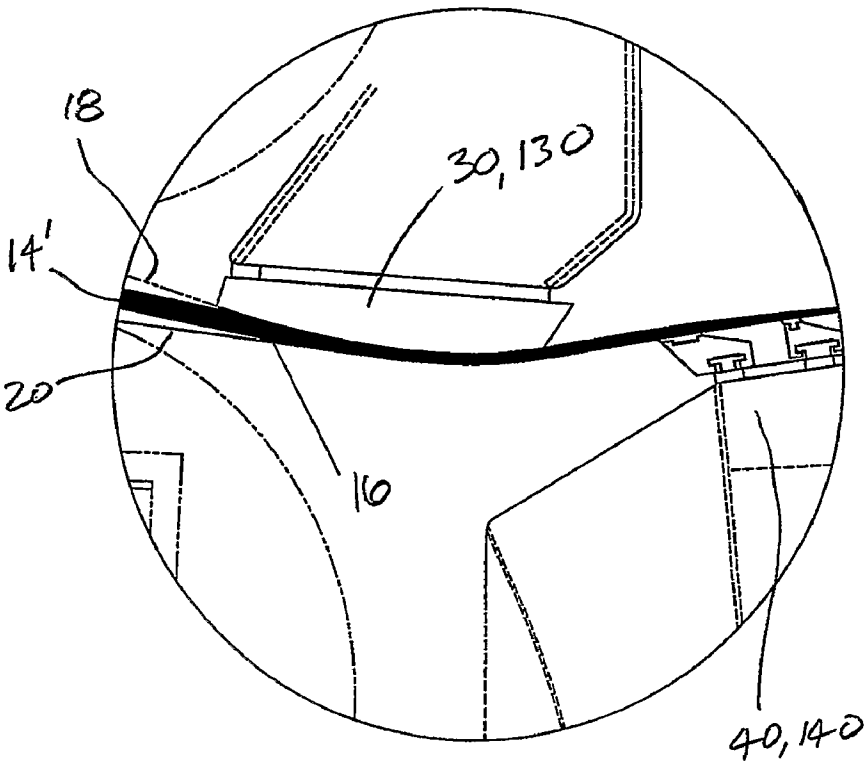
FIGS. 7 and 7*a* show the impingement shoe and forming shoe after an adjustment of the position of the impingement shoe and the forming shoe from that shown in FIG. 6 in order to reduce the wrap angle of the forming fabrics at the trailing edge of the impingement shoe and leading edge of the forming shoe.
Figure 7:
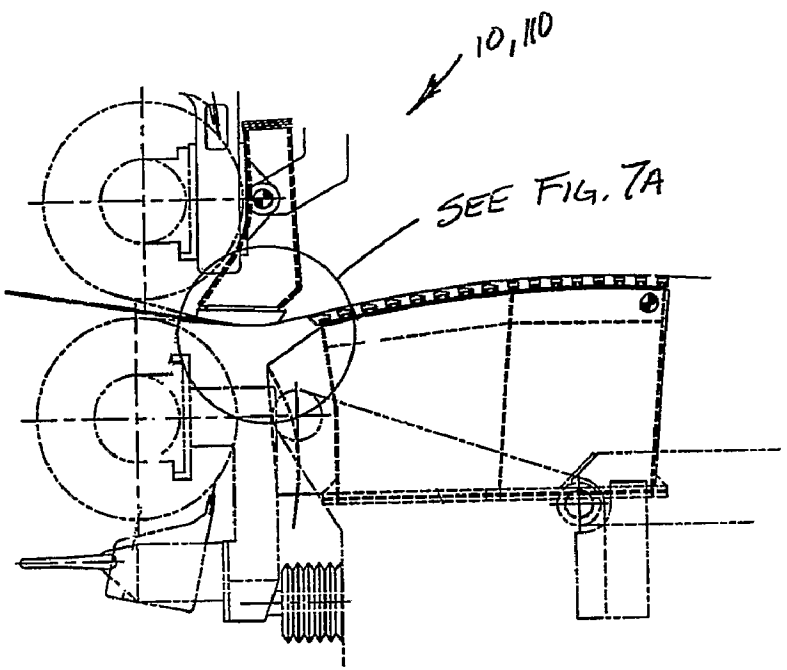

Referring to FIGS. 7 and 7*a*, this is easily corrected according to the present invention by at least one of moving the impingement shoe 30, 130 by pivoting and/or transverse movement as well as the forming shoe 40, 140 by pivoting and/or transverse movement in order to reduce the fabric deflection angle of the conveying fabric 18, backing fabric 20 and the stock trapped therebetween at a position between a trailing edge of the impingement shoe 30, 130 and a leading edge of the forming shoe 40, 140.

It is noted that a thickness of the sandwiched fabrics 18, 20 and papermaking stock can be adjusted by a number of factors, including changing the impingement point 16 on the impingement shoe 30, 130 and the effective wrap angle. For example, for a thicker stock, providing an impingement point 16 closer to a leading edge of the impingement shoe 30, 130 with a greater wrap angle would result in more drainage being carried out on the impingement shoe 30, 130 and result in a reduced sandwiched thickness. However, for a thin stock, in order to maintain a proper tension and fabric deflection angle between a trailing edge of the impingement shoe 30, 130 and a leading edge of the forming shoe 40, 140, it may be desirable to have less drainage carried out on the impingement shoe 30, 130. Therefore it could be desirable to adjust the impingement point 16 to a position closer to the trailing edge of the impingement shoe 30, 130, for example as shown in FIG. 3.

According to the invention, adjustments in a location of the impingement point 16 on the impingement shoe 30, 130 as well as the fabric deflection angle between the trailing edge of the impingement shoe 30,130 and a leading edge of the forming shoe 40, 140 can be easily adjusted via one or more of the actuators 36, 136, 139, 148 and 154, preferably using a controller for easy adjustment during changeovers to mill runs of different types of paper. This used to entail a laborious process of shutting down the equipment and manually adjusting the impingement and/or forming shoe locations prior to restarting the equipment. Only when the equipment was restarted would it be possible to determine whether the proper adjustment had been made. In accordance with the invention, the moveable impingement shoe 30, 130 and/or forming shoe 40, 140 can both be easily moved to adjust the forming section for forming different types of paper webs. This can be carried out prior to or during operation of the papermaking machine allowing for minute adjustments on the fly in order to improve the quality of the paper web being formed. The result is that the papermaking machine can efficiently produce a wider variety of paper products with a shorter turnaround time than has hitherto been possible.

A variety of mechanisms are available which will impart sufficient accurate movement (rotational and/or linear) of the leading edge of either or both the impingement shoe and forming shoe. Selection of any one of these will be dictated by machine design and layout (the mechanism should not interfere with any other units, showers, pans or mountings) as well as papermaking conditions and customer requirements. The actual mechanism may include a simple single pivot arrangement, a double sliding mechanism, where each end is moved linearly along a fixed path, or a combination of both, or other suitable arrangements. Rotational movement can be provided by a drive actuator, such as a cross shaft and screw jack arrangement driven by an electric motor. Alternatively, hydraulic or pneumatic actuators or drives could be utilized.

Those skilled in the art will recognize from the present disclosure that some or all of the benefits of the invention can be obtained by utilizing a movable impingement shoe, a movable forming shoe, or both.

It will be recognized by those skilled in the art that changes can be made to the above-described embodiments of the invention without departing from the broad inventive process thereof which provides an impingement shoe and/or a forming shoe which can be moved, either independently or in a linked manner, in order to allow adjustments to both the impingement point of the jet of papermaking stock and the effective wrap angle, as well as the fabric deflection angle between a trailing edge of the impingement shoe and a leading edge of the forming shoe in order to provide improved paper web formation. It is understood therefore that the invention is not limited to the particular embodiments disclosed, but is intended to cover all modifications which are within the spirit and scope of the invention as defined by the appended claims.

The invention claimed is:

1. A forming section for a gap blade former type papermaking machine, the forming section having a machine direction and comprising:

a. a headbox which delivers a jet of papermaking stock;

b. a lead-in roll located immediately downstream of the headbox;

c. a conveying forming fabric and a backing forming fabric, each mounted for advancing movement in the machine direction and having facing advancing sides between which an embryonic paper web is formed;

d. an impingement shoe over which the conveying forming fabric moves in sliding contact and the jet of papermaking stock is delivered onto the conveying fabric at a point of impingement located over the impingement shoe;

e. a forming shoe, located immediately downstream of the impingement shoe, over which the backing forming fabric slides;

the impingement shoe is mounted with an adjustment mechanism for linear movement in the machine direction or a combination of pivoting and the linear movement, from a fixed first position to one of a plurality of fixed second positions so that a position of the point of impingement of the jet of papermaking stock on the conveying fabric in an area of sliding contact over the impingement shoe is adjusted by linear movement of the impingement shoe in the machine direction or by a combination of rotating the impingement shoe about a first pivot point and the linear movement of the impingement shoe.

2. A forming section according to claim 1, wherein the lead-in roll is linked to the impingement shoe so that adjustments to the position of the impingement shoe provide corresponding adjustments to a position of the lead-in roll.

3. A forming section according to claim 1, further comprising the forming shoe being mounted with a mounting for linear movement in the machine direction or a combination of pivoting and the linear movement so that a position of at least a leading edge of the forming shoe is adjustable by linear movement or a combination of rotating the forming shoe about a second pivot point and the linear movement of the forming shoe from a first fixed forming shoe position to one of a plurality of second fixed forming shoe positions in order to adjust a fabric deflection angle of the conveying fabric.

4. A forming section according to claim 3, wherein the second pivot point is located at or near a downstream side of the forming shoe.

5. A forming section according to claim 1, wherein a position of the impingement shoe is adjusted by at least one actuator.

6. A forming section according to claim 1, further comprising a first actuator connected to the impingement shoe that is adapted to rotate the impingement shoe about the first pivot point, a second actuator that is adapted to linearly shift the first pivot point, and a controller connected to the first and second actuators to control movement of the actuators in order to move the impingement shoe from the fixed first position to one of a plurality of fixed second positions so that the position of the point of impingement of the jet of papermaking stock on the conveying fabric in the area of sliding contact over the impingement shoe is adjusted.

7. A forming section for a gap blade former type papermaking machine, the forming section having a machine direction and comprising:

a. a headbox which delivers a jet of papermaking stock;

b. a lead-in roll located immediately downstream of the headbox;

c. a conveying forming fabric and a backing forming fabric, each mounted for advancing movement in the machine direction and having facing advancing sides between which an embryonic paper web is formed;

d. an impingement shoe over which the conveying fabric moves in sliding contact and the jet of papermaking stock is delivered to the conveying fabric at a point of impingement located over the impingement shoe;

e. a forming shoe, located immediately downstream of the impingement shoe, over which the backing forming fabric slides;

f. the impingement shoe is mounted with an adjustment mechanism for at least one of pivoting and linear movement in the machine direction from a fixed first position to one of a plurality of fixed second positions so that a position of the point of impingement of the jet of papermaking stock on the conveying fabric in an area of sliding contact over the impingement shoe is adjusted by at least one of rotating the impingement shoe about a first pivot point and linearly shifting the impingement shoe; and g. the forming shoe is linked to the impingement shoe such that movement of the impingement shoe provides a corresponding movement of the forming shoe.

8. A forming section according to claim 7, wherein the forming shoe is linked to the impingement shoe by a mechanical linkage.

9. A method of forming an embryonic paper web in a forming section for a gap blade former type papermaking machine, comprising:

a. providing a headbox which delivers a jet of papermaking stock to a point of impingement between a conveying forming fabric and a backing forming fabric, each mounted for advancing movement in a machine direction of the papermaking machine and having facing advancing sides between which the embryonic paper web is formed, and an impingement shoe over which the conveying fabric moves in sliding contact and the jet of papermaking stock is delivered to the conveying fabric at the point of impingement located over the impingement shoe;

b. mounting the impingement shoe for linear movement in the machine direction or a combination of pivoting and the linear movement;

adjusting a position of the point of impingement of the jet of papermaking stock on the conveying fabric in an area of sliding contact over the impingement shoe by linearly shifting the impingement shoe or a combination of rotating the impingement shoe about a first pivot point and linearly shifting the impingement shoe, from a fixed first position to one of a plurality of fixed second positions prior to or during operation of the papermaking machine.

10. A method according to claim 9, further comprising mounting the forming shoe for linear movement in the machine direction or for a combination of pivoting and the linear movement so that a position of the forming shoe is adjustable, and adjusting a position of the forming shoe by linearly shifting the forming shoe in the machine direction or a combination of rotating the forming shoe about a second pivot point and linearly shifting the forming shoe from a first fixed forming shoe position to one of a plurality of second fixed forming shoe positions.

11. A method according to claim 9, further comprising adjusting the position of the point of impingement to a location closer to a leading edge of the impingement shoe for heavy paper stock.

12. A method according to claim 9, further comprising adjusting the impingement shoe location so that an effective wrap angle is reduced.

13. A method according to claim 9, further comprising providing a first actuator connected to the impingement shoe that is adapted to rotate the impingement shoe about the first pivot point, a second actuator that is adapted to linearly shift the first pivot point, and a controller connected to the first and second actuators, and controlling movement of the actuators with the controller in order to move the impingement shoe from the fixed first position to one of a plurality of fixed second positions.

14. A method of forming an embryonic paper web in a forming section for a gap blade former type papermaking machine, comprising:

a. providing a headbox which delivers a jet of papermaking stock to a point of impingement between a conveying forming fabric and a backing forming fabric, each mounted for advancing movement in a machine direction for the papermaking machine and having facing advancing sides between which the embryonic paper web is formed, and an impingement shoe over which the conveying fabric moves in sliding contact and the jet of papermaking stock is delivered to the conveying fabric at the point of impingement located over the impingement shoe;

b. mounting the impingement shoe for at least one of pivoting movement or linear movement in the machine direction;

c. adjusting a position of the point of impingement of the jet of papermaking stock on the conveying fabric in an area of sliding contact over the impingement shoe by at least one of rotating the impingement shoe about a first pivot point or linearly shifting the impingement shoe in the machine direction from a fixed first position to one of a plurality of fixed second positions prior to or during operation of the papermaking machine; and d. linking the forming shoe to the impingement shoe such that movement of the impingement shoe provides a corresponding movement of the forming shoe.

15. A forming section for a gap blade former type papermaking machine, the forming section having a machine direction and comprising:

a. a headbox which delivers a jet of papermaking stock;

b. a lead-in roll located immediately downstream of the headbox;

c. a conveying forming fabric and a backing forming fabric, each mounted for advancing movement in the machine direction and having facing advancing sides between which an embryonic paper web is formed;

d. an impingement shoe over which the conveying fabric moves in sliding contact and the jet of papermaking stock is delivered to the conveying fabric at a point of impingement located over the impingement shoe;

e. a forming shoe located immediately downstream of the impingement shoe over which the backing forming fabric slides;

f. the forming shoe is mounted for linear movement in the machine direction or for a combination of pivoting movement and the linear movement, from a first fixed forming shoe position to one of a plurality of second fixed forming shoe positions so that a fabric deflection angle of the conveying fabric in an area between a trailing edge of the impingement shoe and a leading edge of the forming shoe is adjustable by linearly shifting the forming shoe or a combination of rotating the forming shoe about a first pivot point and linearly shifting the forming shoe.

16. A forming section according to claim 15, further comprising the impingement shoe being mounted for at least one of pivoting and linear movement in the machine direction from a fixed first position to one of a plurality of fixed second positions so that a position of the point of impingement of the jet of papermaking stock on the conveying fabric in an area of sliding contact over the impingement shoe is adjusted by at least one of rotating the impingement shoe about a first pivot point and linearly shifting the impingement shoe.

17. A forming section according to claim 16, wherein the forming shoe is linked to the impingement shoe such that movement of the forming shoe provides a corresponding movement of the impingement shoe.

18. A forming section according to claim 17, wherein the forming shoe is linked to the impingement shoe by a mechanical linkage.

19. A forming section according to claim 17, wherein movement of the forming shoe is linked to the impingement shoe by at least one controller.

* * * * *